US007852233B2

(12) United States Patent
Cemper

(10) Patent No.: US 7,852,233 B2
(45) Date of Patent: Dec. 14, 2010

(54) DRIVER NOTIFICATION SYSTEM, DEVICE, AND ASSOCIATED METHOD

(75) Inventor: Kirk E. Cemper, Richardson, TX (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 577 days.

(21) Appl. No.: 11/771,718

(22) Filed: Jun. 29, 2007

(65) Prior Publication Data

US 2009/0002193 A1 Jan. 1, 2009

(51) Int. Cl.
*G08G 1/00* (2006.01)

(52) U.S. Cl. ..... 340/901; 340/902; 340/988; 340/425.5; 340/435; 340/436; 455/99

(58) Field of Classification Search ..... 340/901, 340/902, 903, 904, 988, 425.5, 435, 436, 340/500, 539.1, 539.11; 455/99; 342/42
See application file for complete search history.

(56) References Cited

U.S. PATENT DOCUMENTS 3,840,868 A * 10/1974 Campman ..... 340/555
5,400,045 A * 3/1995 Aoki ..... 345/7
5,515,026 A * 5/1996 Ewert ..... 340/436
5,889,475 A * 3/1999 Klosinski et al. ..... 340/902
6,472,978 B1 * 10/2002 Takagi et al. ..... 340/435
2003/0020880 A1 * 1/2003 Knoll et al. ..... 353/13
2004/0217869 A1 * 11/2004 Bouchard et al. ..... 340/573.4
2005/0073438 A1 * 4/2005 Rodgers et al. ..... 340/944

* cited by examiner

*Primary Examiner*—George A Bugg
*Assistant Examiner*—Kerri McNally

(57) ABSTRACT

Devices, systems, and methods are provided for alerting a driver that a potential hazard is in the vicinity of the driver's vehicle. In general, activation signals transmitted from a vehicle are received at a potential hazard, and hazard signals are, in response, transmitted from the potential hazard to the vehicle. The hazard signals provide an indication of the potential hazard to the driver so that he may be aware of the potential hazard and react accordingly. The indication may be provided to the driver visually, such as on a display of the vehicle, and/or audibly, such as in the form of an audible alert issued by a speaker. The hazard signals may also include one or more characteristics of the potential hazard to provide more information about the potential hazard to the driver, such as the type of potential hazard and/or the degree of danger associated with the potential hazard.

25 Claims, 7 Drawing Sheets

DRIVER NOTIFICATION SYSTEM, DEVICE, AND ASSOCIATED METHOD

BACKGROUND

Drivers on the road today face many potential hazards and obstacles. From construction and road closures to pedestrians and emergency vehicles, unexpected objects or circumstances in the path of a moving vehicle may be dangerous to the driver of the vehicle and to those around him, or at the very least may cause a driver frustration or anxiety.

It is thus often helpful for a driver to know what lies on the road ahead. If a driver is distracted or not focusing on the road, even for a second, a potential hazard may be too close for the vehicle to avoid. The result may range from fear and anxiety over a "near miss" situation to property damage or personal injury of the driver himself or others on the road.

Thus, there is a need for a system that provides a driver with an indication of potential hazards in the vicinity of the driver's vehicle in an informative and non-obtrusive manner.

BRIEF DESCRIPTION OF THE SEVERAL VIEWS OF THE DRAWING(S)

DETAILED DESCRIPTION

Exemplary embodiments now will be described hereinafter with reference to the accompanying drawings, in which exemplary embodiments and examples are shown. Like numbers refer to like elements throughout.

Devices, systems, and methods for alerting a driver that a potential hazard is in the vicinity of the driver's vehicle are provided in accordance with various exemplary embodiments. In general, devices, systems and methods are described for detecting the presence of a receiving vehicle at a potential hazard and communicating hazard signals from the potential hazard to the vehicle. The hazard signals received provide an indication of the potential hazard to the driver of the vehicle so that the driver may be aware of the potential hazard and may react accordingly. The indication may be provided to the driver visually, such as on a display, and/or audibly, such as in the form of an audible alert. The hazard signals may also include one or more characteristics of the potential hazard that provide more information about the potential hazard to the driver.

Figure 1:
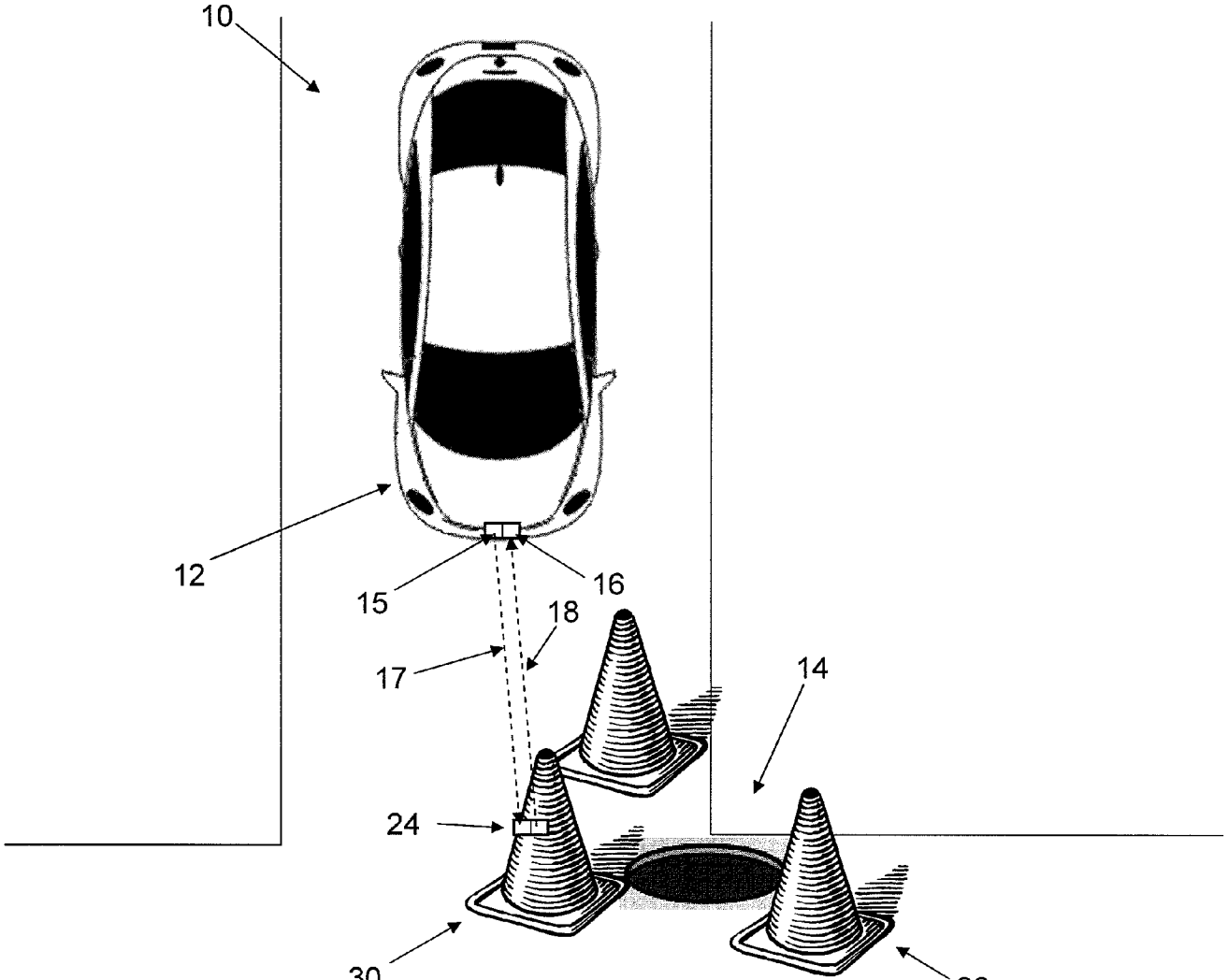
FIG. 1 is a schematic representation of a system for alerting a driver of a potential hazard according to one embodiment.

FIG. 1 illustrates a system 10 for alerting a driver inside a vehicle 12 of a potential hazard 14. In FIG. 1, for example, the potential hazard is an exposed manhole. In this example, an exposed manhole may pose a potential hazard to a driver who is unaware of the exposed manhole and drives right over it, causing damage to his vehicle. At the same time, the exposed manhole may be a potential hazard to the crew working in or around the manhole as they may be accidentally hit by a distracted driver. Potential hazards 14 may come in many other shapes and forms. For example, potential hazards may include various other types of road work or construction activities, crosswalks, student driver vehicles, pedestrians, and emergency vehicles, to name a few.

Figure 2:
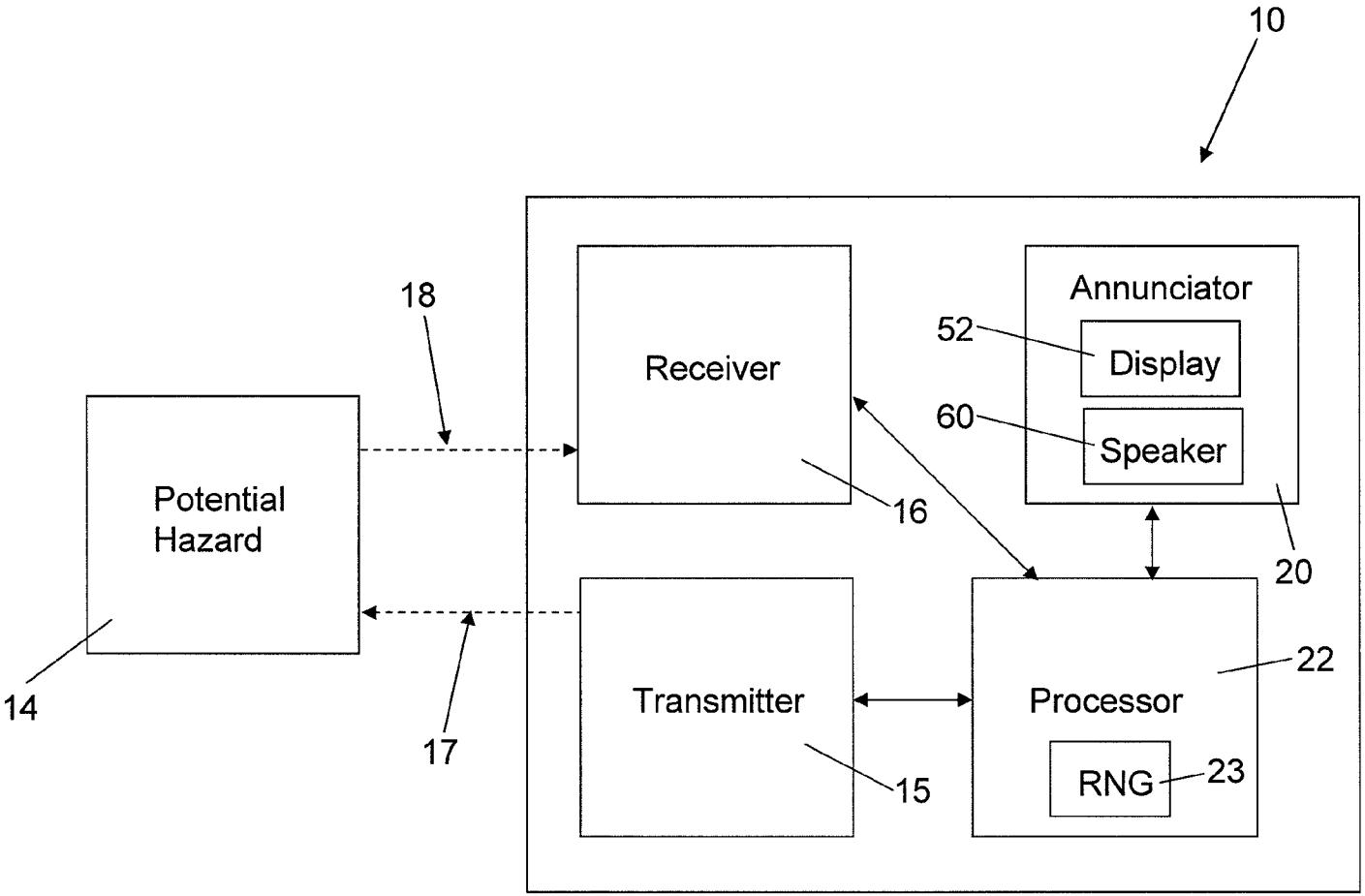
FIG. 2 is a schematic block diagram of a system for alerting a driver according to one embodiment.

Referring to FIG. 2, regardless of the type of potential hazard 14, the system 10 of one embodiment includes a vehicle transmitter 15 and a vehicle receiver 16, as well as an annunciator 20 and a processor 22. The transmitter 15 is configured to transmit activation signals 17 to any potential hazard 14 in proximity to the transmitter 15. The receiver 16 is configured to receive hazard signals 18 generated by a device associated with a potential hazard 14 in response to the activation signals 17. The annunciator 20 is configured to indicate the at least one potential hazard based on the hazard signals 18 received, and the processor 22, which is in communication with the transmitter 15, the receiver 16 and the annunciator 20, is configured to interpret the hazard signals 18 received and to instruct the annunciator 20 to provide each indication.

Typically, the transmission and reception of the activation signals 17 and hazard signals 18 is performed wirelessly. The potential hazards 14 may remain passive, or in a state in which the potential hazards 14 are not generating or transmitting hazard signals 18, until the device associated with a particular potential hazard 14 receives an activation signal 17, indicating the presence of a vehicle in the vicinity. As a result, the device associated with the potential hazard 14 may generate hazard signals 18 to alert the vehicle of the potential hazard 14. In contrast, the vehicle transmitter 15 may be transmitting activation signals 17 continuously as the vehicle is traveling. For example, the transmitter 15 may be powered by a mobile power source of the vehicle (not shown), such as an engine or battery.

Figure 7:
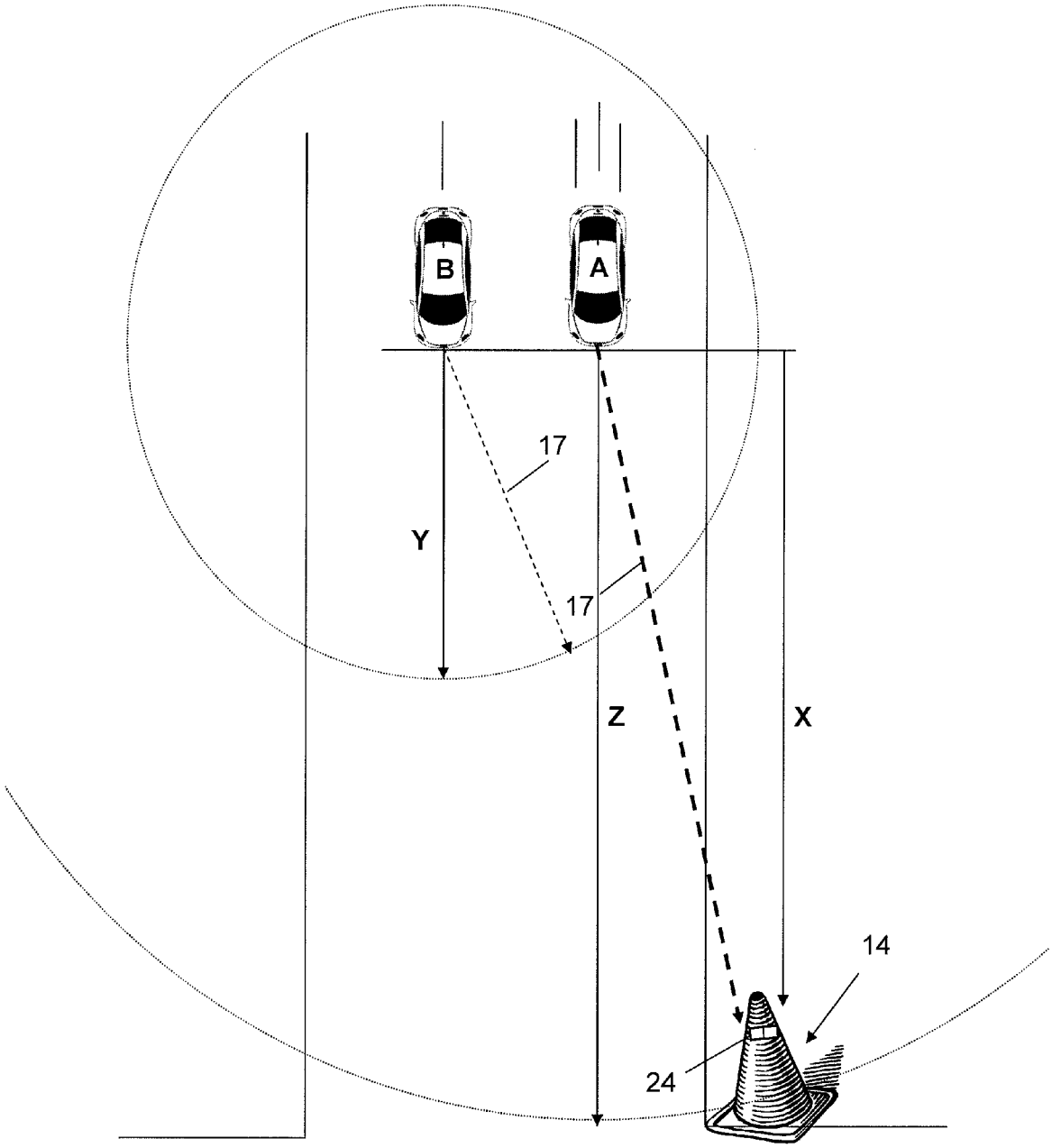
FIG. 7 is an illustration of a vehicle device for providing activation signals at an amplitude based on velocity according to one embodiment.

Furthermore, the amplitude at which the transmitter 15 may transmit the activation signals 17 may vary depending on the speed of the vehicle. In other words, the signal strength of the activation signals 17 may be associated with the speed of the vehicle. For example, instead of transmitting the activation signals 17 at a constant amplitude (i.e., a constant strength), the transmitter 15 may transmit the activation signals 17 at an amplitude that is a function of the velocity of the vehicle. For instance, FIG. 7 shows two vehicles A, B approaching a potential hazard 14 and associated device. Vehicles A and B are at the same distance X away from the potential hazard 14. However, vehicle A is traveling three times as fast as vehicle B (as represented by three velocity lines coming off the rear of vehicle A as compared to the one line off B). The function typically implemented by the processor 22 that provides appropriate commands to the transmitter 15 governing the amplitude of the activation signals 17 may dictate that the higher velocity vehicle A transmit the activation signals 17 at a greater amplitude (higher strength) than the lower velocity vehicle B, as indicated by the darker dashed line representing the activation signals 17. The signals 17 from vehicle A may thus be attenuated (i.e., become too weak to be detected) at a distance Z, whereas the activation signals 17 from vehicle B may be attenuated at a shorter distance Y. In this way, the activation signals 17 from vehicle A may reach the potential hazard 14 even though the lower signal strength of vehicle B do not. Thus, a potential hazard 14 may generate hazard signals 18 in response to the activation signals 17 from vehicle A such that vehicle A (which is traveling faster) may receive those hazard signals 18 in time to process and act upon the information provided.

Figure 3:
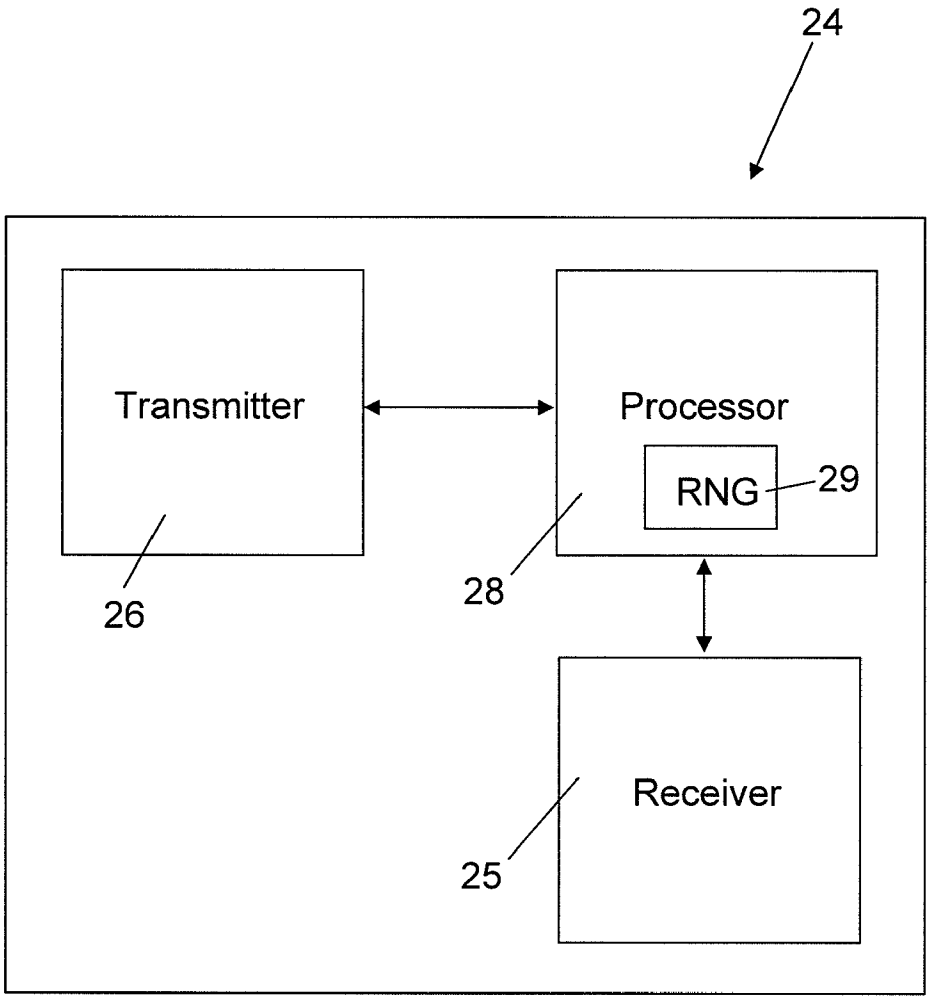
FIG. 3 is a schematic block diagram of a device for providing hazard signals according to one embodiment.

Referring now to FIG. 3, the hazard signals 18 may be transmitted by a device 24 located at the potential hazard 14. The device 24 includes a receiver 25 and a transmitter 26 at the location of the potential hazard 14. The receiver 25 is configured to receive the activation signals 17 from the transmitter of the vehicle, as previously described. The transmitter 26 is configured to generate hazard signals 18 in response to the activation signals 17 received. The device 24 further includes a processor 28 in communication with the receiver 25 and the transmitter 26 that is configured to include at least one characteristic of the potential hazard in the hazard signals 18.

In some embodiments, the activation signals 17 transmitted by the vehicle transmitter 15 may include an indication of the speed of the vehicle. For example, the transmitter 15 of a vehicle traveling at 50 mph may transmit activation signals 17 including an indication of that speed. A device 24 at a potential hazard 14 receiving such activation signals 17 may be configured to transmit hazard signals 18 via the processor 28 and the transmitter 26 at an amplitude based on the indication of speed. For example, the transmitter 26 may be instructed by the processor 28 to transmit the hazard signals 18 at a higher amplitude based on information included in the activation signals 17 that the transmitting vehicle is traveling at a higher speed. In this way, the higher-speed vehicle may be able to receive the hazard signals 18 at a farther distance away from the potential hazard 14, thereby giving the driver more time to react accordingly.

Figure 4A:
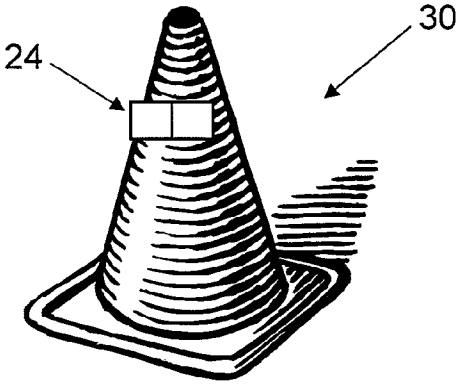
FIG. 4A is an illustration of a device carried by a traffic cone associated with a potential hazard according to one embodiment.
Figure 4B:
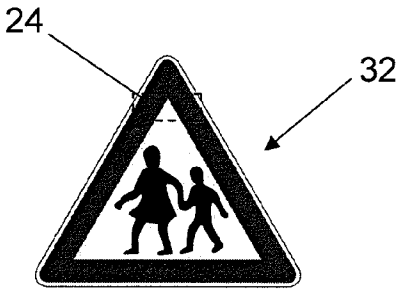
FIG. 4B is an illustration of a device carried by a traffic sign associated with a potential hazard according to another embodiment.
Figure 4C:
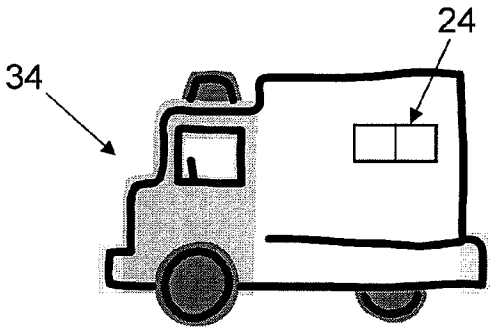
FIG. 4C is an illustration of a device carried by an emergency vehicle associated with a potential hazard according to another embodiment.
Figure 4D:
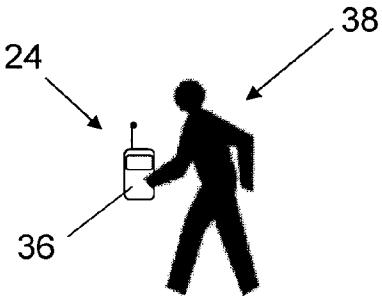
FIG. 4D is an illustration of a device carried by a pedestrian according to another embodiment.

The device 24, or at least receiver 25 and/or the transmitter 26 of the device 24, may be located in or on, or otherwise carried by, any of the objects defining the potential hazard 14. For example, referring to FIG. 4A, the device 24 may be attached to a traffic cone 30 forming the perimeter of the potential hazard 14, as illustrated in FIG. 1. In instances where the potential hazard is a crosswalk or school crossing, the device 24 may be attached to the back of a warning or traffic sign 32, as depicted in FIG. 4B, or may be incorporated in a motion sensor positioned to sense pedestrian traffic at the crosswalk. Likewise, an emergency vehicle 34, such as a tow truck, ambulance, police car, or fire truck, may have the device 24 attached to an interior or exterior component of the emergency vehicle 34, as shown in FIG. 4C. Furthermore, a pedestrian may carry the device 24 on his person such that receivers 16 in the vicinity may be alerted to his presence. In some cases, the device may include or be part of a mobile terminal 36, such as a mobile phone, carried by the pedestrian 38, as shown in FIG. 4D. For example, a blind pedestrian may carry the device 24 as a way to alert drivers in the area that the blind pedestrian is near the roadway. Examples of such device are described in U.S. patent application Ser. No. 11/771,684 entitled "Automobile Beacon, System, and Associated Method" (Verizon Reference Number 20070131), filed concurrently, which is incorporated herein in its entirety by reference. Many other potential hazards, not shown in FIGS. 4A-4D or mentioned here, may also be configured to carry the device 24.

The processor 28 of the device 24 may be configured to modulate the hazard signals 18 and transmit data to include one or more characteristics of the potential hazard 14. For example, the processor 28 may instruct the transmitter 26 to transmit a modulated radio frequency burst at a constant amplitude that includes a header, such as a 40-bit header. The header may include one or more characteristics of the potential hazard 14, such as the type of potential hazard 14 present (e.g., pedestrian, construction, emergency vehicle, etc.) and a degree of danger associated with the potential hazard 14 (e.g., high, medium, or low), among others.

Both the vehicle transmitter 15 and the device transmitter 26 may be configured to transmit their respective signals 17, 18 in random bursts. For example, the time between bursts may be governed by a random number generator (RNG) 23, 29 in each processor 22, 28 as shown in FIGS. 2 and 3, respectively. Thus, although two vehicles may both be transmitting activation signals 17 at 100 bursts per second, for example, the intervals between bursts (i.e., how the 100 bursts are distributed through that one second of time) may be governed by the RNG 23, and the distribution of the 100 bursts may be different as between the two vehicles. In this way, creation of a complex Fresnel field as a result of multiple vehicles transmitting activation signals 17 according to a constant function (e.g., a constant sine wave) may be avoided, and the risk of activation signals 17 transmitted by one vehicle canceling out activation signals 17 transmitted by another vehicle may be reduced. Although when a number of vehicles are present it may still be statistically possible for random bursts from two vehicle transmitters 15 to cancel each other out, the duration of the cancellation would be relatively insignificant (on the order of 1/100 of a second, using the example above) and would have no practical effect.

Similarly, once the device 24 has received the activation signals 17, the transmitter 26 of the device 24 may be configured to transmit the hazard signals 18 in random bursts. In this way, as described above, the vehicle receiver 16 may be able to receive hazard signals 18 from more than one potential hazard 14 at or near the same time as hazard signals 18 transmitted by transmitters 26 from different potential hazards 14 may be less likely to interfere with each other. Furthermore, even if one instance of signal transmission (or burst) from one potential hazard 14 occurs at the same time as a burst from another potential hazard 14 in the area, causing the two potential hazards 14 to be indistinguishable to the vehicle receiver 16 or not apparent at all, the next random burst from each transmitter 26 would statistically not occur at the same time. Thus, the effect of the signal interference would be, at most, transient, as described above.

Once hazard signals 18 are received at the vehicle receiver 16, from one or more potential hazards 14, the processor 22 of the system 10 shown in FIG. 2 may instruct the annunciator 20 to provide the indication of the potential hazard 14 in various ways. In instances in which the hazard signals 18 include information regarding characteristics of the hazard, such as by modulation or otherwise, the processor 22 may be configured to demodulate, parse, or otherwise process the hazard signals 18 to recover the information regarding characteristics of the potential hazard 14. The annunciator 20 itself may include visual and/or audio components. The annunciator 20 may, for example, include a display 52 configured to provide a visual representation of the indication and/or may include a speaker 60 configured to issue an audible alert, as described below. In FIG. 2, for example, the annunciator 20 includes both a display 52 and a speaker 60.

Figure 5:
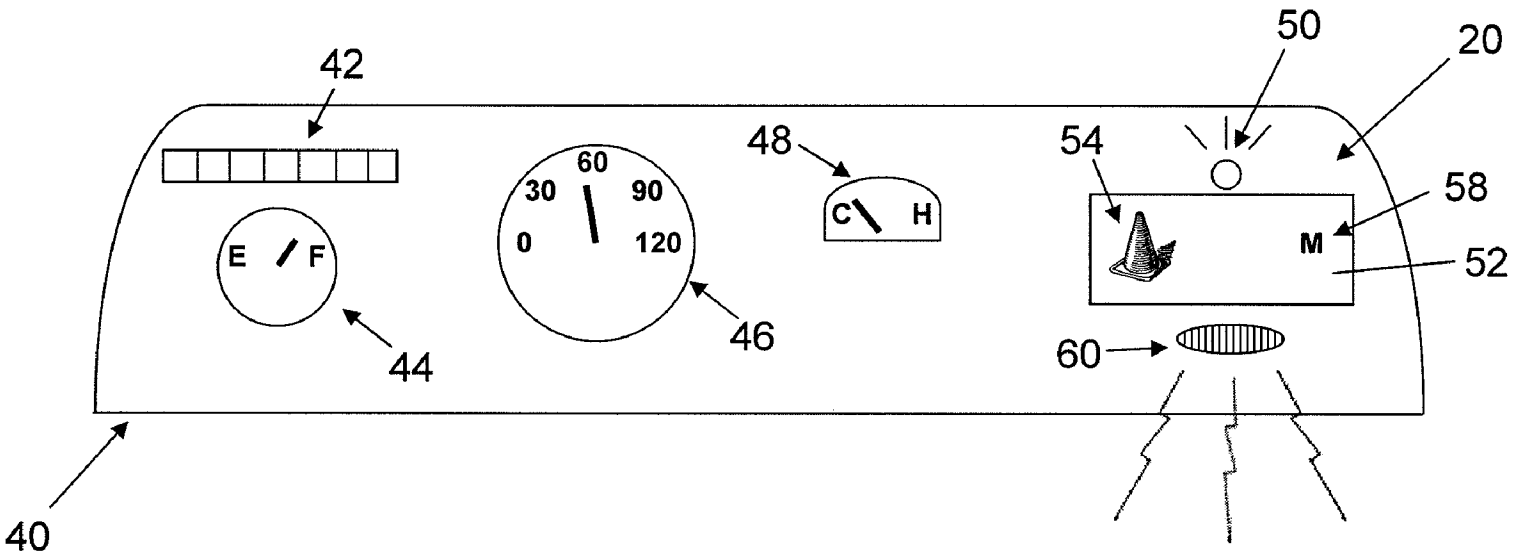
FIG. 5 is a schematic illustration of a vehicle dashboard including a display and a speaker according to one embodiment.
Figure 6:
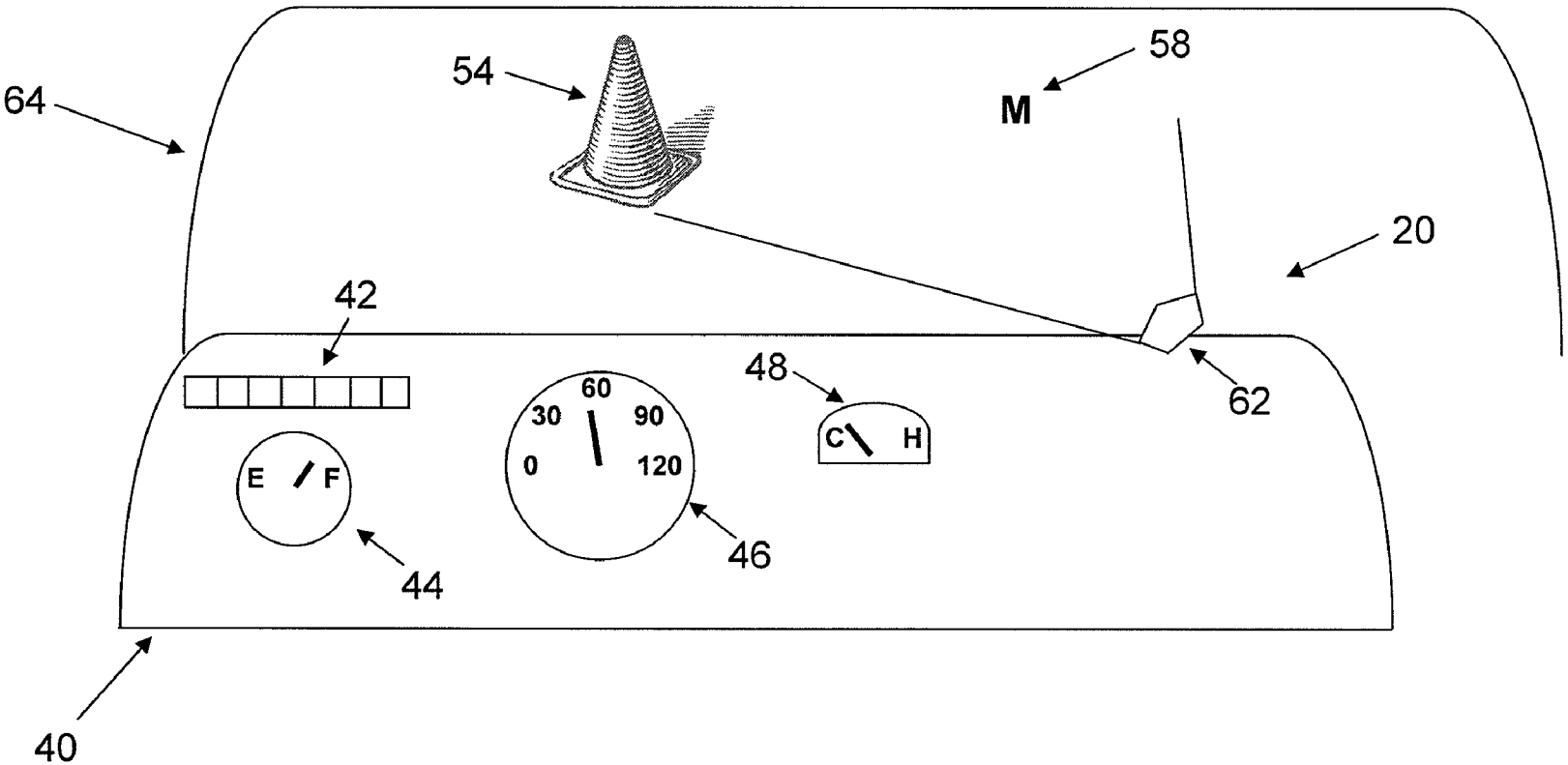
FIG. 6 is a schematic illustration of a vehicle dashboard including a projector according to another embodiment.

Referring to FIG. 5, for example, a vehicle dashboard 40 may include the display 52 for providing one or more indications of the potential hazards 14. The display 52 may be positioned, for example, alongside other controls and gauges that facilitate vehicle operation, such as an odometer 42, fuel gauge 44, speedometer 46, and temperature gauge 48, among others. For example, the display 52 may include a light or LED 50 to indicate that hazard signals 18 from a potential hazard 14 were received and in this way call the attention of the driver to the display 52 to find out more about the potential hazard. The display 52 may also provide further details regarding the potential hazard 14. For example, one or more characteristics of the potential hazard 14 that may have been included in the hazard signals 18 received (e.g., through modulation of the signals, as previously discussed) may be provided by the processor 22 for presentation by the display 52 in graphical and/or textual form. In FIG. 5, for example, the image of a traffic cone 54 may represent the type of potential hazard 14 as being construction or road work. Other information, such as the degree of danger 58 associated with the potential hazard 14 (M, or medium), may also be presented on the display 52.

Furthermore, the speaker 60 may be included as part of the annunciator 20 to provide an audible alert to the driver. The processor 22 may thus be in communication with the speaker 60 and may be configured to instruct the speaker 60 to issue the alert based on the hazard signals 18 received by the receiver 16. If the speaker 60 is provided in addition to the display 52, as in FIG. 5, the speaker 60 may simply provide a tone to call the attention of the driver to the display 52. Alternatively, the speaker 60 may announce the characteristics of the potential hazard 14 to the driver so that the driver does not need to look away from the road to view the display 52. For the example presented above, the speaker 60 may make the following announcement: "Road work ahead. Medium degree of danger involved."

In some embodiments, the annunciator 20 may include a projector 62 that is configured to project the indication of the potential hazard 14 on a windshield 64 of the vehicle. For example, the projector 62 may project the image of a traffic cone 54 representing a construction zone and may also project other characteristics of the potential hazard 14, such as the degree of danger 58 associated with the potential hazard 14. Projection of the indication, which may include one or more characteristics of the potential hazard 14, may allow the driver to continue looking ahead at the road while viewing the details regarding the potential hazard 14 in or near his line of sight, thereby effecting a form of "heads-up" display.

The processor 22 may be further configured to instruct the annunciator 20 to provide the indication of each potential hazard for a predetermined amount of time after the respective hazard signals 18 are no longer being received by the receiver 16. For example, there may be a delay of 2 seconds between the time the last hazard signal 18 (i.e., the last burst) is received by the receiver 16 and the time the processor 22 instructs the annunciator 20 to discontinue presenting the indication of the potential hazard 14 to the driver. In this way, any transient interference with the hazard signals 18, such as interference caused by other hazard signals 18 or by physical obstructions, such as tunnels or walls, may be allowed to dissipate without preventing the driver from perceiving the indication. Thus hazard signals 18 transmitted from a potential hazard 14 that may be intermittently obscured from the receiver 16 may still be noticeable to the driver and duly considered.

In some embodiments, the processor 22 may be configured to distinguish between potential hazards 14 that are being approached by the vehicle 12 and those that the vehicle 12 has already passed. For example, the processor 22 may consider the amplitude of the hazard signals 18 to determine whether the hazard signals 18 are increasing in strength or decreasing in strength. An increase in the strength of the hazard signals 18, for example, may indicate that the vehicle 12 is approaching the potential hazard 14, whereas a decrease in the strength of the hazard signals 18 may indicate that the vehicle 12 is moving away from the location of the potential hazard 14. In this regard, the annunciator 20 may be configured to provide an indication of the potential hazard 14 only for those potential hazards 14 that are being approached (i.e., the potential hazards 14 that lie ahead considering the current direction of the vehicle's travel), rather than for both potential hazards 14 that are being approached and for those that have already been passed or avoided.

In the preceding specification, various embodiments of the claimed invention have been described. It will, however, be evident that various modifications and changes may be made thereunto without departing from the broader spirit and scope of the invention as set forth in the claims that follow. The specification and drawings are accordingly to be regarded in an illustrative rather than restrictive sense.

That which is claimed:

1. A system comprising:

a transmitter configured to transmit activation signals to any potential hazard in proximity to the transmitter, wherein the activation signals have an amplitude based at least in part on a speed associated with the transmitter and include an indication of the speed associated with the transmitter;

a receiver configured to receive hazard signals generated by at least one potential hazard in response to the activation signals, wherein the hazard signals have an amplitude based at least in part on the indication of the speed associated with the transmitter;

an annunciator configured to indicate the at least one potential hazard based on the hazard signals received; and a processor in communication with the transmitter, the receiver, and the annunciator and configured to interpret the hazard signals received and to instruct the annunciator to provide each indication.

2. The system of claim 1, wherein the transmitter is configured to transmit the activation signals continuously.

3. The system of claim 1, wherein the receiver is configured to receive hazard signals generated by at least one potential hazard selected from the group consisting of a pedestrian, a road construction crew, a crosswalk, a student driver vehicle, and an emergency vehicle.

4. The system of claim 1, wherein the receiver is configured to receive hazard signals that include at least one characteristic of the potential hazard.

5. The system of claim 4, wherein the receiver is configured to receive hazard signals that are modulated to include the at least one characteristic.

6. The system of claim 4, wherein the receiver is configured to receive hazard signals that include the at least one characteristic selected from the group consisting of a type of the potential hazard and a degree of danger associated with the potential hazard.

7. The system of claim 1, wherein the annunciator comprises a display configured to provide a visual representation of each indication.

8. The system of claim 1, wherein the annunciator comprises a projector configured to project each indication on a windshield of a vehicle.

9. The system of claim 1, wherein the processor is configured to instruct the annunciator to provide the indication of each potential hazard for a predetermined amount of time after the respective hazard signals are no longer received by the receiver.

10. The system of claim 1, wherein the annunciator comprises at least one speaker in communication with the processor, wherein the at least one speaker is configured to issue an audible alert, and wherein the processor is configured to instruct the at least one speaker to issue the alert based on the hazard signals received by the receiver.

11. A device comprising:

a receiver at a location of a potential hazard configured to receive activation signals, wherein the activation signals have an amplitude based at least in part on a speed associated with an activation signals transmitter and include an indication of the speed associated with the activation signals transmitter;

a transmitter at the location of the potential hazard configured to generate hazard signals in response to the activation signals, wherein the hazard signals have an amplitude based at least in part on the indication of the speed associated with the activation signals transmitter; and a processor in communication with the receiver and the transmitter and configured to include at least one characteristic of the potential hazard in the hazard signals.

12. The device of claim 11, wherein the processor is configured to modulate the hazard signals to include the at least one characteristic of the potential hazard in the hazard signals.

13. The device of claim 11, wherein the transmitter is configured to transmit the hazard signals in random bursts.

14. The device of claim 11, wherein at least one of the receiver and the transmitter is located at a potential hazard selected from the group consisting of a pedestrian, a road construction crew, a crosswalk, a student driver vehicle, and an emergency vehicle.

15. The device of claim 11, wherein the device comprises a mobile terminal.

16. The device of claim 11, wherein the receiver, the transmitter, and the processor are carried by the potential hazard.

17. A method comprising:

transmitting, via a transmitter, activation signals from a vehicle to a potential hazard in proximity to the vehicle, wherein the activation signals have an amplitude based at least in part on a speed of the vehicle and include an indication of the speed of the vehicle;

receiving, via a receiver, vehicle hazard signals generated at the potential hazard in response to the activation signals, wherein the vehicle hazard signals have an amplitude based at least in part on the indication of the speed of the vehicle; and providing, via an annunciator, an indication of the potential hazard to a driver of the vehicle.

18. The method of claim 17 further comprising determining at least one characteristic of the potential hazard.

19. The method of claim 18, wherein determining the at least one characteristic comprises determining at least one characteristic selected from the group consisting of a type of the potential hazard and a degree of danger associated with the potential hazard.

20. The method of claim 18, wherein providing the indication comprises providing an indication of the at least one characteristic determined.

21. The method of claim 17, wherein providing the indication comprises providing the indication for a predetermined amount of time after the hazard signals are no longer received.

22. The method of claim 17, wherein providing the indication comprises providing a visual representation of the indication on a display of the vehicle.

23. The method of claim 17, wherein providing the indication comprises including a visual representation of the indication with an image generated by a navigation system of the vehicle.

24. The method of claim 17, wherein providing the indication comprises projecting the indication on a windshield of the vehicle.

25. The method of claim 17, wherein providing the indication comprises issuing an audible alert in response to receiving the hazard signals.

* * * * *